US005300398A

United States Patent [19]

Kaszczuk

[11] Patent Number: 5,300,398

[45] Date of Patent: Apr. 5, 1994

[54] INTERMEDIATE RECEIVER CUSHION LAYER

[75] Inventor: Linda Kaszczuk, Webster, N.Y.

[73] Assignee: Eastman Kodak Company, Rochester, N.Y.

[21] Appl. No.: 749,026

[22] Filed: Aug. 23, 1991

[51] Int. Cl.[5] ..... B41M 5/00; G03C 11/00

[52] U.S. Cl. ..... 430/200; 430/201; 430/256; 430/259; 430/262; 503/227

[58] Field of Search ..... 430/199, 200, 201, 203, 430/256, 259, 262; 428/195; 503/227

[56] References Cited

U.S. PATENT DOCUMENTS

| | | | |
|---|---|---|---|
| 3,369,903 | 2/1968 | Harvey | 430/262 |
| 3,370,950 | 2/1968 | Verelst et al. | 430/262 |
| 4,409,316 | 10/1983 | Zeller-Pendrey et al. | 430/262 |
| 4,600,669 | 7/1986 | Ng et al. | 430/47 |
| 4,657,831 | 4/1987 | Ambro et al. | 430/14 |
| 4,686,163 | 8/1987 | Ng et al. | 430/47 |
| 4,734,396 | 3/1988 | Harrison et al. | 428/913 |
| 4,737,486 | 4/1988 | Henzel | 430/945 |
| 4,923,848 | 5/1990 | Akada et al. | 503/227 |
| 4,965,242 | 10/1990 | DeBoer et al. | 430/201 |
| 4,990,485 | 2/1991 | Egashira et al. | 503/227 |
| 5,023,229 | 6/1991 | Evans et al. | 430/201 |
| 5,045,392 | 9/1991 | Daems et al. | 430/256 |
| 5,073,534 | 12/1991 | Harrison et al. | 430/201 |
| 5,077,263 | 12/1991 | Henzel | 428/914 |
| 5,085,969 | 2/1992 | Namiki et al. | 430/262 |

FOREIGN PATENT DOCUMENTS

| | | |
|---|---|---|
| 0266430 | 5/1988 | European Pat. Off. . |
| 0281031 | 9/1988 | European Pat. Off. . |
| 0455214 | 11/1991 | European Pat. Off. . |
| 61-295094 | 12/1986 | Japan . |
| 63-017091 | 1/1988 | Japan . |
| 1-155349 | 6/1989 | Japan . |
| 2-3057 | 1/1990 | Japan . |

OTHER PUBLICATIONS

USSN 07/514,643 of DeBoer, filed Apr. 25, 1990.

*Primary Examiner*—Charles L. Bowers, Jr.
*Assistant Examiner*—M. Angebranndt
*Attorney, Agent, or Firm*—Harold E. Cole

[57] ABSTRACT

A thermal dye transfer process, and intermediate receiver used therein, for obtaining a color image which is used to represent a printed color image obtained from a printing press comprising (a) forming a thermal dye transfer image in a polymeric dye image-receiving layer of an intermediate dye-receiving element comprising a support having thereon said dye image-receiving layer by imagewise-heating a dye-donor element and transferring a dye image to the dye image-receiving layer, (b) adhering the dye image-receiving layer to a surface of a final receiver element by heat laminating the intermediate dye receiving element to the final receiver element, and (c) stripping the intermediate dye receiving element support from the dye image-receiving layer, wherein the intermediate dye receiving element further comprises a cushion layer between the support and the dye image-receiving layer, the shear modulus of the cushion layer being less than the shear modulus of the support and less than ten times the shear modulus of the dye image-receiving layer at the temperature of lamination in step (b), and wherein the cushion layer is stripped from the dye image-receiving layer along with the support in step (c).

16 Claims, No Drawings

INTERMEDIATE RECEIVER CUSHION LAYER

This invention relates to a thermal dye transfer process and intermediate receiver used therein for obtaining a color proof which is used to represent a printed color image obtained from a printing press, and more particularly to the use of a cushion layer in the intermediate receiver used in the process. For the purpose of this invention, black and white images are considered to fall within the term "color image."

In order to approximate the appearance of continuous-tone (photographic) images via ink-on-paper printing, the commercial printing industry relies on a process known as halftone printing. In halftone printing, color density gradations are produced by printing patterns of dots of various sizes, but of the same color density, instead of varying the color density uniformly as is done in photographic printing.

There is an important commercial need to obtain a color proof image before a printing press run is made. It is desired that the color proof will accurately represent the image quality, details, color tone scale and, in many cases, the halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled. U.S. Pat. No. 4,600,669 of Ng et al., for example, discloses an electro-photographic color proofing system.

In U.S. patent application No. 514,643, filed Apr. 25, 1990, of DeBoer, the disclosure of which is incorporated by reference, a thermal dye transfer process is described for producing a direct digital, halftone color proof of an original image. The proof is used to represent a printed color image obtained from a printing press. The process described therein comprises:

a) generating a set of electrical signals which is representative of the shape and color scale of an original image;

b) contacting a dye-donor element comprising a support having thereon a dye layer and an infrared-absorbing material with a first intermediate dye-receiving element comprising a support having thereon a polymeric, dye image-receiving layer;

c) using the signals to imagewise-heat by means of a diode laser the dye-donor element, thereby transferring a dye image to the first dye-receiving element; and d) retransferring the dye image to a second final dye image-receiving element which has the same substrate as the printed color image.

As set forth in Ser. No. 514,643 described above, an intermediate dye-receiving element is used with subsequent retransfer to a second receiving element to obtain the final color proof. This is similar to the electrophotographic color proofing system of Ng et al. referred to above, which discloses forming a composite color image on a dielectric support with toners and then laminating the color image and support to a substrate to simulate a color print expected from a press run. In both processes, the second or final receiving element can have the same substrate as that to be used for the actual printing press run. This allows a color proof to be obtained which most closely approximates the look and feel of the printed images that will be obtained in the actual printing press run. A multitude of different substrates can be used to prepare the color proof (the second receiver); however, there needs to be employed only one intermediate receiver.

For thermal dye transfer color proofing, the intermediate receiver can be optimized for efficient dye uptake without dye-smearing or crystallization. In the retransfer step, the dyes and receiver binder may be transferred together to the second receiver, or the dyes alone may be transferred where the second receiver is receptive to the dyes. Preferably, the dyes and receiver binder are transferred together to the final color proof receiver in order to maintain image sharpness and overall quality, which may be lessened when the dyes are retransferred alone to the final receiver. This is similar to the electrophotographic color proofing system of Ng et al. which discloses transferring a separable dielectric polymeric support layer together with the composite toner image from an electrophotographic element to the final receiver substrate. Similarly, Japanese Kokais 01-155,349 (published Jun. 19, 1989) and 02-3057 (published Jan. 8, 1990) disclose color proofing systems where photosensitive layers on intermediate supports are exposed and developed, and then transferred along with a heat fusible layer to a final receiver substrate.

Since the final receiver provides the desired background for the proof image, the intermediate support need not provide any particular background for viewing. After transfer of the imaged dye-receiving layer of the intermediate dye-receiving element to the final color proof receiver, the intermediate receiver support may be simply discarded. As such, a simple clear support has been used as disclosed in Ser. No. 514,643 referred to above for economical purposes.

When both the imagewise transferred dyes and the image-receiving layer binder of the intermediate receiving element are transferred to the final receiver substrate, the surface gloss of the final receiver may be altered. In particular, higher gloss generally results when a polymeric dye image-receiving layer is transferred from an intermediate receiver to a final paper stock receiver. Such higher gloss is generally undesirable because it makes accurate judging difficult as to how the proof will represent the final press run. The increased gloss is a result of the transferred polymeric layer surface being smoother than the final receiver substrate itself. This result is believed to occur because the intermediate support is relatively smooth and hard and the transferred polymer layer is generally much softer. Upon lamination of the intermediate receiver element to the final receiver substrate, while the surface of the dye image-receiving layer adhered to the final receiver substrate may conform to the surface of the final receiver, the surface adjacent to the intermediate support remains smooth conforming to the intermediate support surface. Thus, upon stripping the intermediate support, the exposed surface of the transferred polymeric dye image-receiving layer is smooth and exhibits high gloss, even though the final receiver substrate surface may be relatively rougher.

Prior approaches to gloss control problems in color proofing systems include post-transfer roughening of the image layer or pre-roughening of the intermediate support as set forth in Japanese Kokai 02-3057. These solutions impart a roughened surface to the transferred image layer of the color proof which is intended to simulate the roughness and therefore gloss of the printed images that will be obtained on the printing stock in the actual printing press run. These approaches, however, are cumbersome and require controlling the degree of roughening dependent upon the gloss of the final receiver which is to be matched. It would be desirable to obtain a color proof upon transfer of an imaged layer to a final receiver substrate which approximated the gloss of the final receiver substrate itself without having to perform separate roughening treatment.

These and other objects are achieved in accordance with the invention which in one embodiment comprises the process steps of (a) forming a thermal dye transfer image in a polymeric dye image-receiving layer of an intermediate dye-receiving element comprising a support having thereon said dye image-receiving layer by imagewise-heating a dye-donor element and transferring a dye image to the dye image-receiving layer, (b) adhering the dye image-receiving layer to the surface of a final receiver element by heat laminating the intermediate dye receiving element to the final receiver element, and (c) stripping the intermediate dye receiving element support from the dye image-receiving layer, wherein the intermediate dye receiving element further comprises a cushion layer between the support and the dye image-receiving layer, the shear modulus of the cushion layer being less than the shear modulus of the support and less than ten times the shear modulus of the dye image-receiving layer at the temperature of lamination in step (b), and wherein the cushion layer is stripped from the dye image-receiving layer along with the support in step (c).

In a further embodiment, the invention comprises the intermediate receiving element used in the above process.

The use of a polymeric cushion layer of selected shear modulus as set forth above coated underneath the receiving layer of the intermediate receiver used for a laser thermal dye transfer color proofing system such as described in U.S. Ser. No. 514,643 provides significant gloss reduction to make the gloss of the laminated color proof more closely resemble that of the final receiver substrate itself. The gloss control is believed to result from the cushion layer reducing the smoothing effect of the intermediate support upon lamination, so that both surfaces of the transferred polymeric dye image-receiving layer can conform to the surface of the final receiver substrate. While any cushion layer which has a shear modulus, G', less than that of the intermediate support would theoretically help control gloss to some extent, it has been found that the cushion layer shear modulus must be less than about ten times the shear modulus of the dye image-receiving layer for desirable levels of gloss control. For best results, the shear modulus, G', of the cushion layer should be less than that of the dye image-receiving layer. The shear modulus of polymeric materials is discussed in *Introduction to Polymer Viscoelasticity,* 2nd ed., John J. Aklonis and W. J. MacKnight, editors, Wiley Interscience Publications, 1983, the disclosure o which is incorporated by reference.

A variety of polymeric materials may be used for the cushion layer. Composition is not critical providing the shear modulus criteria is fulfilled. Cushion layers may be selected, for example, from polycarbonates, polyesters, polyvinyl acetals, polyurethanes, polyesters, polyvinyl chlorides, polycaprolactones and polyolefins. In particular polyvinyl acetals such as poly(vinyl alcohol-co-butyral), polyolefins such as polypropylene, and linear polyesters derived from dibasic aromatic acids, such as phthalic, or dibasic cycloaliphatic acids, such as cyclohexane dicarboxylic acid, esterified with a short chain aliphatic diol, such as ethylene glycol and an aromatic bisphenol, such as bisphenol-A are preferred.

The polymeric cushion layer is considered effective at coverages of greater than about 0.5 g/m$^2$, preferably from about 5 to 50 g/m$^2$, and most preferably from about 10 to 50 g/m$^2$. Higher levels in these ranges are preferred as the greater resulting thickness is believed to further reduce the smoothing influence of the intermediate support upon lamination of the dye image-receiving layer to the final receiver substrate.

The shear modulus of a polymeric material is temperature dependent. It is therefore important for purposes of the invention that comparisons of shear modulus values for the cushion and dye image-receiving layers be done under conditions approximating those used for lamination.

The intermediate dye-receiving element support may be a polymeric film such as a poly(ether sulfone), a polyimide, a cellulose ester such as cellulose acetate, a poly(vinyl alcohol-co-acetal) or a polyester such as poly(ethylene terephthalate). Alternatively, a paper support may be used. The intermediate support thickness is not critical, but should provide adequate dimensional stability. In general, polymeric film supports of from 5 to 500 μm, preferably 50 to 100 μm, are used. The intermediate support may be clear, opaque, and/or diffusely or specularly reflective. Opaque (e.g. resin coated paper) and reflective (e.g. metal coated polymeric film) supports are preferred when a laser system is used to form the dye image in the dye image-receiving layer as disclosed in copending U.S. Ser. No. 07/606,404 of Kaszczuk et al., the disclosure of which is incorporated by reference.

The dye image-receiving layer may comprise, for example, a polycarbonate, a polyurethane, a polyester, polyvinyl chloride, cellulose esters such as cellulose acetate butyrate or cellulose acetate propionate, poly (styrene-co-acrylonitrile), poly(caprolactone), polyvinyl acetals such as poly(vinyl alcohol-co-butyral), mixtures thereof, or any other conventional polymeric dye-receiver material provided it will adhere to the second receiver. The dye image-receiving layer may be present in any amount which is effective for the intended purpose. In general, good results have been obtained at a concentration of from about 0.2 to about 5 g/m$^2$. For best results in maintaining low gloss, lower levels within this range (i.e., thinner layers) are preferable as thinner layers are believed to conform better to the topography of the final receiver substrate, thereby best maintaining comparable gloss.

The dye-donor that is used in the process of the invention comprises a support having thereon a heat transferable dye-containing layer. The use of dyes in the dye-donor permits a wide selection of hue and color that enables a close match to a variety of printing inks and also permits easy transfer of images one or more times to a receiver if desired. The use of dyes also allows easy modification of density to any desired level.

Any dye can be used in the dye-donor employed in the invention provided it is transferable to the dye-receiving layer by the action of the heat. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination.

In color proofing in the printing industry, it is important to be able to match the proofing ink references provided by the International Prepress Proofing Association. These ink references are density patches made with standard 4-color process inks and are known as SWOP (Specifications Web Offset Publications) Color References. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p. 55. Preferred dyes and dye combinations found to best match the SWOP Color References are the subject matter of commonly assigned U.S. Pat. Nos. 5,024,990 and 5,023,229 and U.S. Ser. Nos. 07/606,399 and 07/677,000 of Chapmann and Evans, the disclosures of which are incorporated by reference.

The dyes of the dye-donor element employed in the invention may be used at a coverage of from about 0.05 to about 1 $g/m^2$, and are dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate; poly(styrene-co-acrylonitrile); a poly(sulfone); a poly(vinyl alcohol-co-acetal) such as poly(vinyl alcohol-co-butyral) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element employed in the invention provided it is dimensionally stable and can withstand the heat needed to transfer the sublimable dyes. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 5 to about 200 μm. It may also be coated with a subbing layer, if desired, such as those materials described in U.S. Pat. Nos. 4,695,288 or 4,737,486.

It is preferred to use a diode laser to transfer dye from the dye donor to the intermediate receiver since it offers substantial advantages in terms of its small size, low cost, stability, reliability, ruggedness, and ease of modulation. In practice, before any laser can be used to heat a dye-donor element, the element must contain an infrared-absorbing material. The laser radiation is then absorbed into the dye layer and converted to heat by a molecular process known as internal conversion.

Lasers which can be used to transfer dye from dye-donors employed in the invention are available commercially. There can be employed, for example, Laser Model SDL-2420-H2 from Spectro Diode Labs, or Laser Model SLD 304 V/W from Sony Corp.

In the above process, multiple dye-donors may be used in combination to obtain as many colors as desired in the final image. For example, for a full-color image, four colors: cyan, magenta, yellow and black are normally used.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the original image, so that the dye is heated to cause volatilization only in those areas in which its presence is required on the dye-receiving layer to reconstruct the color of the original image.

Spacer beads may be employed in a separate layer over the dye layer of the dye-donor in the above-described laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the receiving layer of the dye-receiver as described in U.S. Pat. No. 4,876,235, the disclosure of which is hereby incorporated by reference. The spacer beads may be coated with a polymeric binder if desired.

In a further preferred embodiment of the invention, an infrared-absorbing dye is employed in the dye-donor element instead of carbon black in order to avoid desaturated colors of the imaged dyes from carbon contamination. The use of an absorbing dye also avoids problems of non-uniformity due to inadequate carbon dispersing. For example, cyanine infrared absorbing dyes may be employed as described in U.S. Pat. No. 4,973,572. Other materials which can be employed are described in U.S. Pat. Nos. 4,912,083, 4,942,141, 4,948,776, 4,948,777, 4,948,778, 4,950,639, 4,950,640, 4,952,552, 5,019,480, 5,034,303, 5,035,977, and 5,036,040.

A thermal printer which uses the laser described above to form an image on a thermal print medium is described and claimed in copending U.S. Ser. No. 451,656 of Baek and DeBoer, filed Dec. 18, 1989, the disclosure of which is hereby incorporated by reference.

As noted above, a set of electrical signals is generated which is representative of the shape and color of an original image. This can be done, for example, by scanning an original image, filtering the image to separate it into the desired basic colors (red, blue and green), and then converting the light energy into electrical energy. The electrical signals are then modified by computer to form the color separation data which is used to form a color proof. Instead of scanning an original object to obtain the electrical signals, the signals may also be generated by computer. This process is described more fully in Graphic Arts Manual, Janet Field ed., Arno Press, New York 1980 (p. 358ff), the disclosure of which is hereby incorporated by reference.

The dye-donor element employed in the invention may be used in sheet form or in a continuous roll or ribbon. If a continuous roll or ribbon is employed, it may have alternating areas of different dyes or dye mixtures, such as sublimable cyan and/or yellow and/or magenta and/or black or other dyes. Such dyes, for example, are disclosed in the co-pending applications referred to above.

As noted above, after the dye image is obtained on a first intermediate dye-receiving element, it is retransferred to a second or final receiving element in order to obtain a final color image. For color proofs, the final receiving element comprises a paper substrate. The substrate thickness is not critical and may be chosen to best approximate the prints to be obtained in the actual printing press run. Examples of substrates which may be used for the final receiving element (color proof) include the following: Adproof® (Appleton Paper), Flo Kote Cove® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.) and Mountie Matte® (Potlatch Inc.).

A dye migration barrier layer, such as a polymeric layer, may be applied to the final receiver color proof paper substrate before the dyed image-receiving layer is laminated thereto. Such barrier layers help minimize any dye smear which may otherwise occur and are the subject matter of copending, commonly assigned U.S. Ser. No. 07/606,408 of Chapman et al, the disclosure of which is incorporated by reference.

The imaged, intermediate dye image-receiving layer may be heat laminated to the final receiver (color proof substrate), for example, by passing the intermediate and final receiver elements between two heated rollers, use of a heated platen, use of other forms of pressure and heat, etc., to form a laminate with the imaged intermediate dye image-receiving layer adhered to the final receiver. The selection of the optimum temperature and pressure for the lamination step will depend upon the compositions of the dye image-receiving layer and the final receiver substrate, and will be readily ascertainable by one skilled in the art. In general, lamination temperatures of from about 80° to 200° C. (preferably about 100° to 150° C.) and pressures of from about 20 to 50N are practical for obtaining adequate adhesion between most polymeric dye image-receiving layers and final receiver substrates.

The intermediate support and cushion layer are separated from the dye-image receiving layer after they are laminated to the final receiver substrate. Release agents or stripping layers such as silicone based materials (e.g., polysiloxanes) or other conventional release agents and lubricants may be included between or within the cushion and dye image-receiving layers to facilitate separation.

The following examples are provided to further illustrate the invention.

EXAMPLE 1

To evaluate gloss of a polymeric dye image-receiving layer transferred from an intermediate receiver to a final receiver substrate according to the invention, a simplified test procedure was used. No dye transfer step was employed because gloss measurements are most conveniently done on minimum density white areas. For the dye transfer step of the process of the invention, dye donors may be prepared and laserthermal dye transfer imaging may be performed as set forth in the examples of U.S. Ser. Nos. 07/606,404 and 07/606,408, the disclosures of which are incorporated by reference.

Intermediate dye-receivers were prepared by coating the following layers in order on an unsubbed 100 μm thick poly(ethylene terephthalate) support:

a) a layer of metallic aluminum vacuum deposited using an aluminum source to a coverage of 0.15–0.18 μm
b) an intermediate cushion layer of polymer and dispersant as indicated below
c) a receiving layer of the polymer and dispersant indicated below each containing crosslinked poly(styrene-co-divinylbenzene) beads (12 micron average particle diameter) (0.09 g/m$^2$)

The following polymers were used in the cushion layer.

A1: A linear polyester derived from 1,4-cyclohexane dicarboxylic acid, ethylene glycol, and 4,4'-bis(2-hydroxyethyl) bisphenol-A (50 mole percent ethylene glycol) (9.1 g/m$^2$), with 510 Silicone Fluid (Dow Corning Co) (0.01 g/m$^2$) from dichloromethane.

A2: A linear polyester derived from terephthalic acid, ethylene glycol, and 4,4'-bis(2-hydroxyethyl) bisphenol-A (50 mole % ethylene glycol) (8.8 g/m$^2$) mixed with Tone P-300® (a polycaprolactone of molecular weight about 11,000) (Union Carbide Co.)(0.37 g/m$^2$), with 510 Silicone Fluid (Dow Corning Co) (0.01 g/m$^2$) from dichloromethane.

A3: As A2 except no polycaprolactone was used and the linear polyester was 9.1 g/m$^2$.

A4: A linear polyester derived from terephthalic acid, ethyleneglycol, and 2,2'-(hexahydro-4,7-methanoindene-5-ylidene) bisphenol diethyl ether (50 mole % ethylene glycol) (7.5 g/m), with 510 Silicone Fluid (Dow Corning Co.) from dihloromethane. (Use of this cushion layer was without the vacuum deposited aluminum layer, instead a poly(acrylonitrile-co-vinylidene chloride-co-acrylic acid) (14:79:7 wt. ratio) subbing layer coated from dichloromethane was used).

A5: Butvar B-76® (a polyvinyl alcohol-co-butyral) (Monsanto Corp.) (9.1 g/m$^2$) with 1248 Silicone Fluid (Dow Corning Co.) (0.01 g/m$^2$).

A6: Polyethylene (a blend of approximately 80% low density polyethylene and 20% high density polyethylene) (29. g/m$^2$) by extrusion coating.

The following polymers were used in the receiving layer.

B1: Butvar B-76® (a polyvinyl alcohol-co-butyral) (Monsanto Corp.) (4.0 g/m$^2$) with Fluorad FC-431 (a fluorinated dispersant) (0.04 g/m$^2$) from ethanol.

B2: The linear polyester of A2 (2.4 g/m$^2$) with Tone P-300® (a polycaprolactone) (Union Carbide Co.)

(0.16 g/m²) and 510 Silicone Fluid (Dow Corning Co.) (0.01 g/m²) from dichloromethane.

B3: The linear polyester of A3 (2.5 g/m²) with 510 Silicone Fluid (Dow Corning Co.) (0.01 g/m²) from dichloromethane.

B4: The linear polyester of A4 (2.5 g/m²) with 510 Silicone Fluid (Dow Corning Co.) (0.01 g/m²) from dichloromethane.

B5: Butvar B-76® (a polyvinylalcohol-co-butyral) (Monsanto Corp.) (4.0 g/m²) with 1248 Silicone Fluid (Dow Corning Co.) (0.01 g/m²) from butanone.

As a control to illustrate a "high gloss" upper limit, an intermediate dye-receiver was coated on a 100 μm thick poly(ethylene terephthalate) support consisting of a receiver layer of Butvar B-76® (a polyvinyl alcohol-co-butyral) (Monsanto Corp.) (4.0 g/m²) with 1248 Silicone Fluid (Dow Corning Co.) (0.01 g/m²) and cross-linked poly(styrene-co-divinylbenzene) beads (12 micron average particle diameter) (0.09 g/m²) from butanone. This control contained no metallic aluminum layer or cushion layer.

As a control to illustrate a "low gloss" lower limit the color proof paper stock itself was used.

To illustrate the concept of the invention, heated roller laminations were made. An intermediate receiver was laminated to Textweb paper (60 pound paper stock) (Champion Papers) by passage through a set of juxtaposed rollers at a rate of 30 cm/min. The rollers were of 10 cm diameter, the upper compliant silicone rubber powered roller and lower Teflon coated steel roller were each heated independently to provide a desired nip temperature of 100° C., 130° C., or 147° C. The force applied between the rollers was 36N.

After lamination the paper stock was peeled from the intermediate receiver with the polymeric receiving layer adhered to its surface. The residual part (cushion layer, metal aluminum layer, and support) of the intermediate receiver was discarded.

The gloss of the paper stock with adhering polymeric receiving layer was measured. A Gardner Multiple-Angle Digital Glossgard (a glossmeter of Pacific Science Co.) used to determine 60-degree incident gloss measurements was calibrated using a Specular Gloss Standard (Standard Number 538) with a 60 degree gloss value of 93.6.

In a separate evaluation the shear modulus was measured for each of the individual layer compositions using a Rheometrics Mechanical Spectrometer Model 800E (Rheometrics Laboratories, Piscataway, N.Y.) equipped with its 8 mm diameter parallel plate accessory (gap ranging from 0.7 to 2.0 mm). The samples were cooled at 2° C./min and the storage shear modulus, G' was measured under low shear at 10 rads/sec (1.59 Hz frequency). The shear modulus determined on the polymer alone, or in combination with the polymeric beads and surfactant were not significantly different. Thus the shear modulus measured for the polymer is representative of that of the layer as coated.

The following results (Table I) were obtained. The C/R values given are the shear modulus of the cushion layer divided by the shear modulus of the receiver layer. The gloss values are on a continuous scale with limits effectively defined by the controls; higher values indicate higher gloss.

TABLE I

| LAYER | | | SHEAR MODULUS, G' (MPa) | | | |
|---|---|---|---|---|---|---|
| Cushion | Receiver | Lam. Temp. | Cushion | Receiver | C/R | Gloss |
| — | — | — | — | — | — | 17.(1) |
| — | B1 | 100° C. | >1000(2) | 6.4 | >50 | 101. |
| A1 | B1 | 100° C. | 0.83 | 6.4 | 0.13 | 25. |
| A5 | B2 | 100° C. | 6.4 | 9.2 | 0.70 | 38. |
| A2 | B1 | 100° C. | 9.2 | 6.4 | 1.4 | 43. |
| A3 | B1 | 100° C. | 19. | 6.4 | 3.0 | 48. |
| A4* | B1* | 100° C. | >1000 | 6.4 | >50 | 98. |
| — | B1 | 130° C. | >1000(2) | 3.3 | >50 | 82. |
| A1 | B1 | 130° C. | 0.031 | 3.3 | 0.01 | 18. |
| A6 | B5 | 130° C. | 0.1 | 3.3 | 0.03 | 15. |
| A5 | B3 | 130° C. | 3.3 | 5.3 | 0.62 | 48. |
| A2 | B1 | 130° C. | 2.3 | 3.3 | 0.70 | 21. |
| A3 | B1 | 130° C. | 5.3 | 3.3 | 1.6 | 31. |
| A4* | B1* | 130° C. | 110 | 3.3 | 33 | 82. |
| — | B1 | 147° C. | >1000(2) | 2.1 | >50 | 83. |
| A2 | B1 | 147° C. | 0.65 | 2.1 | 0.31 | 31. |
| A3 | B1 | 147° C. | 1.8 | 2.1 | 0.86 | 23. |
| A5 | B3 | 147° C. | 2.1 | 1.8 | 1.2 | 48. |
| A5 | B2 | 147° C. | 2.1 | 0.65 | 3.2 | 46. |
| A4 | B1 | 147° C. | 14. | 2.1 | 6.7 | 48. |

(1)This is the inherent low limit gloss of the Textweb paper stock itself.
(2)Control coating with no cushion layer. The shear modulus of the adjacent layer (i.e. the support) was measured and tabulated.
*These combinations are considered comparisons because they have a difference in shear modulus outside the scope of the invention.

The data above show that at a variety of lamination temperatures, the gloss of a paper proofing stock laminated with a polymeric receiving layer will be minimized when the intermediate receiver used for lamination has a cushion layer underneath the polymeric receiving layer with a shear modulus no more than ten times that of the receiving layer, i.e. when the C/R values are less than 10.

EXAMPLE 2

This example is the same as Example 1 except the lamination was done to Quintessence Gloss Paper (80 pound stock) (Potlatch Corp.), an interently higher gloss paper stock.

Intermediate receivers were prepared as in Example 1.

The shear modulus and gloss was measured as in Example 1. The following results (Table II) were obtained:

TABLE II

| LAYER | | | SHEAR MODULUS, G' (MPa) | | | |
|---|---|---|---|---|---|---|
| Cushion | Receiver | Lam. Temp. | Cushion | Receiver | C/R | Gloss |
| — | — | — | — | — | — | 24.(1) |
| — | B1 | 100° C. | >1000(2) | 6.4 | >50 | 97. |
| A1 | B1 | 100° C. | 0.83 | 6.4 | 0.13 | 54. |
| A5 | B3 | 100° C. | 6.4 | 19. | 0.34 | 56. |
| A2 | B1 | 100° C. | 9.2 | 6.4 | 1.4 | 61. |
| A3 | B1 | 100° C. | 19. | 6.4 | 3.0 | 72. |
| A4* | B1* | 100° C. | >1000 | 6.4 | >50 | 91. |
| — | B1 | 130° C. | >1000(2) | 3.3 | >50 | 88. |
| A1 | B1 | 130° C. | 0.031 | 3.3 | 0.009 | 28. |
| A6 | B5 | 130° C. | 0.1 | 3.3 | 0.03 | 26. |
| A2 | B1 | 130° C. | 2.3 | 3.3 | 0.70 | 51. |
| A3 | B1 | 130° C. | 5.3 | 3.3 | 1.6 | 52. |
| A5 | B2 | 130° C. | 3.3 | 2.3 | 1.4 | 54. |
| A4* | B1* | 130° C. | 110 | 3.3 | 33 | 77. |
| — | B1 | 147° C. | >1000(2) | 2.1 | >50 | 81. |
| A5 | B4 | 147° C. | 2.1 | 14. | 0.15 | 58. |
| A3 | B1 | 147° C. | 1.8 | 2.1 | 0.86 | 24. |
| A5 | B3 | 147° C. | 2.1 | 1.8 | 1.2 | 55. |
| A5 | B2 | 147° C. | 2.1 | 0.65 | 3.2 | 53. |

TABLE II-continued

| LAYER | | | SHEAR MODULUS, G' (MPa) | | | |
|---|---|---|---|---|---|---|
| Cushion | Receiver | Lam. Temp. | Cushion | Receiver | C/R | Gloss |
| A4 | B1 | 147° C. | 14. | 2.1 | 6.7 | 63. |

(1)This is the inherent low limit gloss of the Quintessence Gloss paper stock itself.
(2)Control coating with no cushion layer. The shear modulus of the adjacent layer (i.e. the support) was measured and tabulated.
*These combinations are considered comparisons because they have a difference in shear modulus outside the scope of the invention.

The data above show the same relationships between shear modulus of the receiving layer and shear modulus of the cushion layer of the intermediate receiver as in Example 1.

EXAMPLE 3

This example is similar to Examples 1 and 2 and describes the effect of the thickness of the intermediate receiver on gloss for the thermal dye retransfer process.

Intermediate dye receivers were prepared by coating the following layers in order on a 100 μm thick poly (ethylene terephthalate) support:

a) a subbing layer of poly (acrylonitrile-co-vinylidene chloride-co-acrylic acid) (14:80:6 wt. ratio) (0.09 g/m$^2$) coated from butanone b) a cushion layer of a linear polyester derived from terephthalic acid, ethylene glycol, and 4,4'-bis(2-hydroxy-ethyl)bisphenol-A (50 mole percent ethylene glycol) (either 7.2 g/m$^2$ or 13.0 g/m$^2$), mixed with Tone P-300® (a polycaprolactone of molecular weight about 11,000) (either 0.30 g/m$^2$ or 0.54 g/m$^2$) and 510 Silicone Fluid (Dow Corning) (0.01 g/m$^2$) from dichloromethane c) a receiving layer of Butvar B-76® (a polyvinyl alcohol-co-butyral) (Monsanto Corp) (at the indicated level), crosslinked poly(styrene-co-divinyl benzene) beads (12 um average particle diameter) and Fluorad FC-431® (a fluorinated dispersant) (0.04 g/m$^2$) from ethanol.

Heated roller laminations at 120° C. were made as described in Example 2 to Quintessence Gloss Paper (80 pound stock) (Potlatch Corp.). The shear modulus, G', was 4.1 MPa for the cushion layer and 4.2 MPa for the receiving layer at 120° C. After lamination the paper stock was peeled from the intermediate receiver with the polymeric receiving layer adhered to its surface. The residual part (cushion layer, subbing layer, and polyester support) of the intermediate receiver was discarded.

The 60-degree incident gloss of the paper stock with adhering polymeric receiving layer was measured as described in Example 1. The following results (Table III) were obtained:

TABLE III

| LAYER COVERAGE | | |
|---|---|---|
| Cushion | Receiver | Gloss |
| None (Control) | 4.0 g/m$^2$ | 91. |
| 7.5 g/m$^2$ polymer | 4.0 g/m$^2$ | 56. |
| 7.5 g/m$^2$ polymer | 3.2 g/m$^2$ | 51. |
| 7.5 g/m$^2$ polymer | 2.5 g/m$^2$ | 38. |
| 13.5 g/m$^2$ polymer | 4.0 g/m$^2$ | 41. |
| 13.5 g/m$^2$ polymer | 3.2 g/m$^2$ | 38. |
| 13.5 g/m$^2$ polymer | 2.5 g/m$^2$ | 33. |

The data above demonstrates that gloss varies within the range tested and becomes less with decreasing receiver layer thickness. All values are beneficially less than the control of Example 2.

EXAMPLE 4

This example is similar to Example 3 and describes the effect of the thickness of the cushion layer on gloss for the thermal dye retransfer process.

Intermediate dye receivers were prepared as described in Example 3 except the receiver layer was 4.0 g/m$^2$ and the cushion layer was coated at either 13.5 g/m$^2$, 10.8 g/m$^2$, 9.1 g/m$^2$, or 7.5 g/m$^2$ (with the same ratio 96:4 of polyester to polycaprolactone for each coating level).

Heated roller laminations at 120° C. were made as described in Example 3 to Quintessence Gloss Paper (80 pound stock) (Potlatch Corp.).

The 60-degree incident gloss of the paper stock with adhering polymeric receiving layer was measured as described in Example 1. The following results (Table IV) were obtained:

TABLE IV

| LAYER COVERAGE | | |
|---|---|---|
| Cushion | Receiver | Gloss |
| None (Control) | 4.0 g/m$^2$ | 91. |
| 13.5 g/m$^2$ | 4.0 g/m$^2$ | 41. |
| 10.8 g/m$^2$ | 4.0 g/m$^2$ | 46. |
| 9.1 g/m$^2$ | 4.0 g/m$^2$ | 52. |
| 7.5 g/m$^2$ | 4.0 g/m$^2$ | 56. |

The data above show that gloss varies within the range tested and becomes less with increasing cushion layer thickness. All values are beneficially less than the control of Example 2.

The invention has been described in detail with particular reference to preferred embodiments thereof, but it will be understood that variations and modifications can be effected within the spirit and scope of the invention.

What is claimed is:

1. In a process for forming a color image comprising:

(a) forming a thermal dye transfer image in a polymeric dye image-receiving layer of an intermediate dye-receiving element comprising a support having thereon said dye image-receiving layer by image-wise-heating a dye-donor element by means of a laser and transferring a dye image to the dye image-receiving layer, (b) adhering the dye image-receiving layer to a surface of a final receiver element having a given gloss by heat laminating the intermediate dye receiving element to the final receiver element at a selected lamination temperature, and (c) stripping the intermediate dye receiving element support from the dye image-receiving layer, the improvement wherein the intermediate dye receiving element further comprises a cushion layer between the support and the dye image-receiving layer, the cushion layer being present at a concentration of from about 5 to about 50 g/m$^2$, and the shear modulus of the cushion layer being less than the shear modulus of the support and less than ten times the shear modulus of the dye image-receiving layer at the temperature of lamination in step (b), and wherein the cushion layer is stripped from the dye image-receiving layer along with the support in step (c), thereby providing a color image on the final receiver element which has a gloss which approximates said given gloss.

2. The process of claim 1 wherein the shear modulus of the cushion layer is less than the shear modulus of the dye image-receiving layer at the temperature of lamination.

3. The process of claim 2 wherein the cushion layer is present at a concentration greater than the concentration of the dye image-receiving layer.

4. The process of claim 3 wherein the dye image-receiving layer is present at a concentration of from about 0.2 to about 5 $g/m^2$.

5. The process of claim 1 wherein step (a) comprises (i) generating a set of electrical signals which is representative of the shape and color scale of an original image, (ii) contacting a dye-donor element comprising a support having thereon a dye layer and an infrared-absorbing material with an intermediate dye-receiving element comprising a support having thereon the polymeric dye image-receiving layer, and (iii) using the signals to imagewise-heat by means of a diode laser the dye-donor element, thereby transferring a dye image to the intermediate dye image-receiving layer.

6. The process of claim 5 wherein the shear modulus of the cushion layer is less than the shear modulus of the dye image-receiving layer at the temperature of lamination.

7. The process of claim 6 wherein the cushion layer is present at a concentration greater than the concentration of the dye image-receiving layer.

8. The process of claim 7 wherein the dye image-receiving layer is present at a concentration of from about 0.2 to about 5 $g/m^2$.

9. The process of claim 1 wherein the cushion layer is present at a concentration greater than the concentration of the dye image-receiving layer.

10. The process of claim 1 wherein the dye image-receiving layer is present at a concentration of from about 0.2 to about 5 $g/m^2$.

11. The process of claim 1 wherein the cushion layer comprises a polyvinyl acetal, a polyester, or a polyolefin.

12. The process of claim 11 wherein the shear modulus of the cushion layer is less than the shear modulus of the dye image-receiving layer at the temperature of lamination.

13. The process of claim 12 wherein the cushion layer is present at a concentration greater than the concentration of the dye image-receiving layer.

14. The process of claim 13 wherein the dye image-receiving layer is present at a concentration of from about 0.2 to about 5 $g/m^2$.

15. The process of claim 1 wherein the cushion layer is present at a concentration of from greater than 5 $g/m^2$ to about 50 $g/m^2$, and the dye image-receiving layer is present at a concentration of from about 0.2 $g/m^2$ to about 5 $g/m^2$.

16. In a process for forming a color image comprising:

(a) forming a thermal dye transfer image in a polymeric dye image-receiving layer of an intermediate dye-receiving element comprising a support having thereon said dye image-receiving layer by imagewise-heating a dye-donor element by means of a laser and transferring a dye image to the dye image-receiving layer, (b) adhering the dye image-receiving layer to a surface of a final receiver element having a given gloss by heat laminating the intermediate dye receiving element to the final receiver element at a selected lamination temperature, and (c) stripping the intermediate dye receiving element support from the dye image-receiving layer, the improvement wherein the intermediate dye receiving element further comprises a cushion layer between the support and the dye image-receiving layer, the cushion layer being present at a concentration greater than the concentration of the dye image-receiving layer, and the shear modulus of the cushion layer being less than the shear modulus of the support and less than ten times the shear modulus of the dye image-receiving layer at the temperature of lamination in step (b), and wherein the cushion layer is stripped from the dye image-receiving layer along with the support in step (c), thereby providing a color image on the final receiver element which has a gloss which approximates said given gloss.

* * * * *